US009950719B2

(12) United States Patent
Kessner

(10) Patent No.: US 9,950,719 B2
(45) Date of Patent: Apr. 24, 2018

(54) OPERATOR CONTROL SYSTEM FOR OPERATOR CONTROL OF FUNCTIONAL UNITS FOR A RAIL VEHICLE

(71) Applicant: SIEMENS AKTIENGESELLSCHAFT, Munich (DE)

(72) Inventor: Martin Kessner, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/433,127

(22) PCT Filed: Sep. 18, 2013

(86) PCT No.: PCT/EP2013/069328
§ 371 (c)(1),
(2) Date: Apr. 2, 2015

(87) PCT Pub. No.: WO2014/053318
PCT Pub. Date: Apr. 10, 2014

(65) Prior Publication Data

US 2015/0251673 A1 Sep. 10, 2015

(30) Foreign Application Priority Data

Oct. 4, 2012 (DE) ..... 10 2012 218 143

(51) Int. Cl.
*B61L 15/00* (2006.01)

(52) U.S. Cl.
CPC ..... *B61L 15/0027* (2013.01); *B61L 15/0081* (2013.01)

(58) Field of Classification Search
None
See application file for complete search history.

(56) References Cited

U.S. PATENT DOCUMENTS 6,668,216 B2 12/2003 Mays
6,853,890 B1 2/2005 Horst et al.
7,844,312 B2 11/2010 Macht et al.
(Continued)

FOREIGN PATENT DOCUMENTS

CH 676903 A5 3/1991
CN 1848192 A 10/2006
(Continued)

OTHER PUBLICATIONS

IEEE Std 802.1X—2004, "IEEE Standard for local and metropolitan area networks—Port-Based Network Access Control", IEEE Computer Society, Dec. 13, 2004, (Revision of IEEE Std. 802.1X-2001).

(Continued)

*Primary Examiner* — Mussa A Shaawat
*Assistant Examiner* — Kyung Kim
(74) *Attorney, Agent, or Firm* — Laurence Greenberg; Werner Stemer; Ralph Locher

(57) ABSTRACT

An operating system for operating functional units in a rail vehicle. At least one base station is provided in each car of the rail vehicle. Each base station communicates, via a wireless interface, with a mobile terminal of an authenticated user, in particular an authenticated train conductor, who operates functional units of the rail vehicle via a graphical user interface of the mobile terminal.

18 Claims, 7 Drawing Sheets

(56) References Cited

U.S. PATENT DOCUMENTS

| | | | | |
|---|---|---|---|---|
| 2003/0214417 | A1 | 11/2003 | Peltz et al. | |
| 2005/0125113 | A1 | 6/2005 | Wheeler et al. | |
| 2005/0259598 | A1 | 11/2005 | Griffin et al. | |
| 2006/0232444 | A1 | 10/2006 | Lee | |
| 2008/0032711 | A1* | 2/2008 | Macht | H04H 20/62 455/456.5 |
| 2009/0248223 | A1 | 10/2009 | Ecton et al. | |
| 2010/0168941 | A1 | 7/2010 | Geiger et al. | |
| 2012/0123617 | A1 | 5/2012 | Noffsinger et al. | |
| 2012/0320875 | A1* | 12/2012 | Ishihara | B60L 15/40 370/331 |

FOREIGN PATENT DOCUMENTS

| | | | |
|---|---|---|---|
| CN | 101426129 | A | 5/2009 |
| CN | 101635045 | A | 1/2010 |
| DE | 3621990 | A1 | 1/1987 |
| DE | 19743306 | A1 | 4/1999 |
| DE | 10042319 | A1 | 3/2002 |
| DE | 10225547 | A1 | 1/2004 |
| DE | 102006023319 | A1 | 12/2007 |
| DE | 60317345 | T2 | 8/2008 |
| EP | 1598255 | A1 | 11/2005 |
| EP | 1603280 | A2 | 12/2005 |
| EP | 2039583 | A | 3/2009 |
| EP | 2071805 | A2 | 6/2009 |
| EP | 2316002 | B1 | 5/2016 |
| WO | 2008031597 | A1 | 3/2008 |

OTHER PUBLICATIONS

Cisco Systems, Inc. "How does Radius work?" Document ID: 12433—updated Jan. 19, 2006.

Schmitz, Barbara et al., "Informations- und Steuerungstechnik auf Schienenfahrzeugen" Elektronik Industrie, Aug. 2008, InnoTrans, Special: Bahnelektronik, pp. 20-22—English abstract.

IEC 62443-3-3 Ed. 1.0, "Security for industrial automation and control systems, Network and system security Part 3-3: System security requirements and security assurance levels"; International Electrotechnical Commission, IEC; 2011.

Wikipedia:, "GSM-R"; Jul. 3, 2012.

Weiss Armin-Hagen et al: "Generic ground side interface for remote train access"; 9th International Conference on Intelligent Transport Systems Telecommunications; Oct. 20, 2009.

Eirene—"European Integrated Railway Radio Enhanced Network"; UIC Project Eirene; System Requirements Specification, Version 15.1; ISBN 2-7461-1832-4; pp. 1-161; Jun. 1, 2010.

Welander, Peter: "An iPhone as Your Next HMI?"; Aug. 31, 2011.

"EIRENE—European Integrated Railway Radio Enhanced Network", Functional Requirements Specification, UIC Code 950 Version 7.3.0, pp. 1-109; Mar. 8, 2012.

Sagemcom TiGR 350R "GSM for Railway communications"; Oct. 14, 2011.

Paul Hsu: White Paper: "The Future of Railway Wireless Communications Networks"; Industrial Wireless Division; Moxa Corporation; Mar. 30, 2010.

* cited by examiner

OPERATOR CONTROL SYSTEM FOR OPERATOR CONTROL OF FUNCTIONAL UNITS FOR A RAIL VEHICLE

BACKGROUND OF THE INVENTION

Field of the Invention

The invention relates to an operator control system for train conductor personnel for operator control of functional units for a rail vehicle or train.

DE 197 43 306 discloses a mobile operator panel for a vehicle that has a control display for presenting data that need to be monitored for the vehicle and comprises an input unit that can be used to perform a prescribed action. In addition, the mobile operator panel contains a computer that presents the data to be monitored on the control display and, on the basis of appropriate operation of the input unit, performs the respective prescribed action.

DE 10 2006 023 319 relates to a system for accessing information and for communication in a high-speed vehicle having a plurality of coupled units. The system comprises a server unit that is set up for providing information and for communication, a plurality of radio access points that are designed for data communication with data processing devices by radio, and a data network that connects the server unit to the radio access points.

US 2005/0 259 598 A1 discloses a radio network (WLAN) within a train having a plurality of cars, wherein each car has an access point or router.

In rail vehicles, particularly trains, having a plurality of cars coupled to one another, many instances require train conductors to operate functional units of the rail vehicle. Examples of such operator control actions are e.g. making adjustments to an air-conditioning system within a car, blocking doors or inputting identified defects, for example faulty interior equipment, within a train car into a system in order to prompt appropriate maintenance for the faulty interior equipment. In addition, train conductors need to react to alarms or warning signals with appropriate remedial measures.

For operator control of functional units of the rail vehicle, for example for operator control of the lighting, the air-conditioning system or of door blocks, and also for state visualization, for example in the case of alarm signals or warnings, conventional rail vehicles contain fixed operator control terminals that are permanently mounted in a train conductor compartment or in a particular switchgear cabinet. Furthermore, train conductors have cordless telephones, particularly DECT-based, for making announcements and for presenting short text messages. The conventional equipment in rail vehicles is inadequate and has significant disadvantages. By way of example, when an alarm or a warning signal occurs, a train conductor must first of all move to a fixed operator control terminal that is located in a train conductor compartment or the like, for example, in order to be able to obtain a complete picture of the situation. Short messages about faults are in some cases also transmitted to the DECT terminals. However, there is no representation of the fault and of possible remedial measures. As a result, valuable time to be able to react to a warning in good time elapses. In addition, the train conductor is unable to perform operator control of the functional unit directly in situ, i.e. in direct proximity to the functional unit that is to be operated. As a result, when operating or adjusting a functional unit, the train conductor is unable to check directly in situ whether the functional unit reacts to his operator control command in the desired manner. This means that there is no assurance of reliable operator control of a functional unit for a conventional rail vehicle.

BRIEF SUMMARY OF THE INVENTION

It is therefore an object of the present invention to provide an apparatus and a method for operator control of functional units for a rail vehicle in which the operator control of the functional units is effected reliably and quickly.

The invention achieves this object by means of an operator control system and a method having the features as claimed.

In one possible embodiment of the operator control system according to the invention, the rail vehicle contains at least one fixed terminal on which the mobile terminal of the user is registered for participation in the operator control system.

In one possible embodiment of the operator control system according to the invention, a position of the mobile terminal of the user within the rail vehicle is recorded.

In one possible implementation, which car of the rail vehicle contains the mobile terminal of the user is additionally recorded.

In a further possible embodiment, the precise location of the mobile terminal of the user within a car of the rail vehicle is additionally recorded.

In one possible embodiment of the operator control system according to the invention, the base station is connected via a car controller to a control bus of a train control system of the rail vehicle that controls the functional units of the rail vehicle.

In a further possible embodiment of the operator control system according to the invention, the operator control of a functional unit of the rail vehicle is effected on the basis of the recorded current position of the mobile terminal of the user.

In a further possible embodiment of the operator control system according to the invention, the current position of the mobile terminal of the user within the rail vehicle is recorded by means of the base stations provided in the different cars of the rail vehicle.

In one possible embodiment of the operator control system according to the invention, the base station is a WLAN base station that communicates with the mobile terminal of the authenticated user bidirectionally via a wireless interface.

In a further possible embodiment of the operator control system according to the invention, the communication between the base station and the mobile terminal of the user is effected in encrypted form.

In a further possible embodiment of the operator control system according to the invention, the authentication of the user to the operator control system is effected on a fixed operator control terminal that is not accessible to unauthorized users.

In a further possible embodiment of the operator control system according to the invention, a display of the mobile terminal of the authenticated user is used to display the current position of further authenticated users of the operator control system.

In a further possible embodiment of the operator control system according to the invention, bidirectional communication between the authenticated user of the mobile terminal and further mobile terminals of further authenticated users of the operator control system is effected via a bus of the train control system within the rail vehicle.

In one possible variant embodiment of the operator control system according to the invention, said operator control system is coupled to an order system, particularly an order system for ordering train tickets (tickets).

In a further possible variant embodiment of the operator control system according to the invention, the operator control system is coupled to a timetable information system, particularly a timetable system for the rail network.

In a further possible variant embodiment of the operator control system according to the invention, the operator control system of the rail vehicle is coupled to a passenger information system.

In a further possible variant embodiment of the operator control system according to the invention, the operator control system of the rail vehicle is coupled to a navigation system or guiding system of the rail vehicle.

Possible embodiments of the operator control system according to the invention and of the method according to the invention for operator control of functional units for a rail vehicle are explained in more detail below with reference to the enclosed figures, in which:

DESCRIPTION OF THE INVENTION

Figure 1:
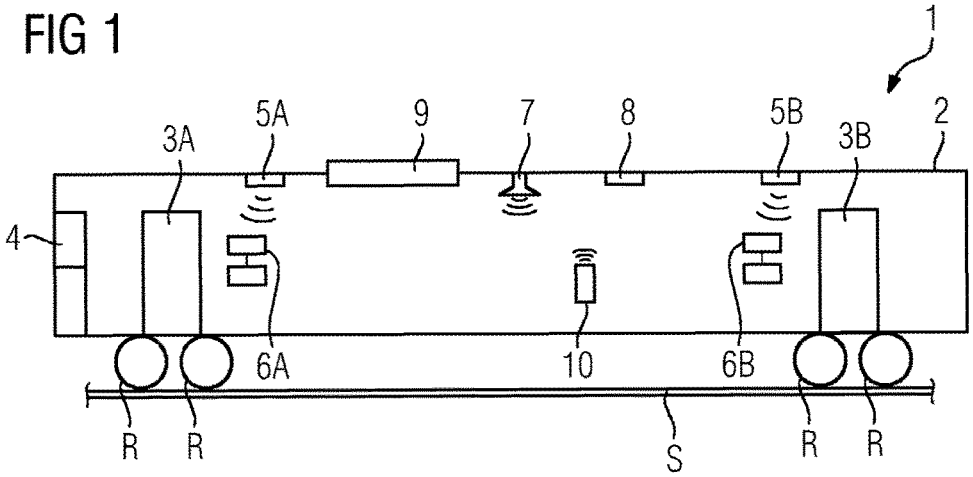
FIG. 1 shows a representation of a car within a rail vehicle to explain the manner of operation of the operator control system according to the invention.
Figure 2:
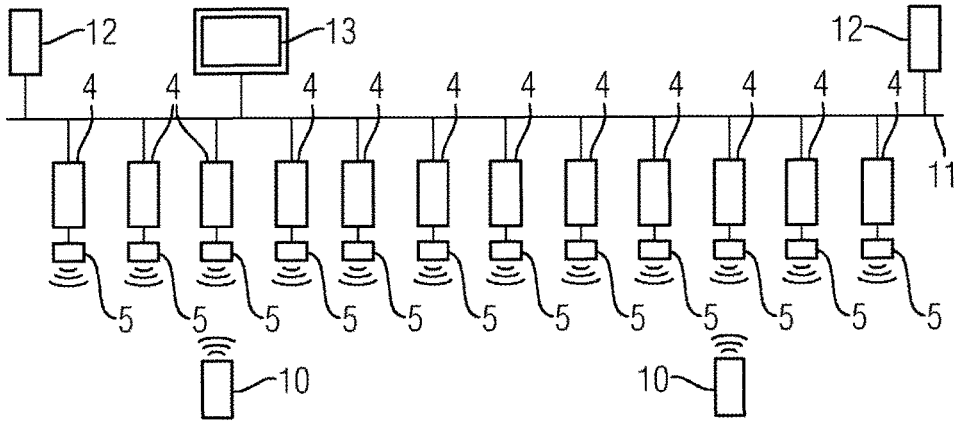
FIG. 2 shows a block diagram to illustrate a variant embodiment of the operator control system according to the invention.

A rail vehicle, particularly a train, has, besides a drive car, a plurality of cars 1 coupled to one another, as shown by way of example in FIG. 1. The car 1 has wheels R that are used to roll over a rail S. The car 1 has a car body 2 that can contain different functional units of the rail vehicle. The rail cars of the rail vehicle are connected to one another via doors and have exterior doors for the passengers. As FIG. 1 shows, each car 1 has, usually on each side, at least two doors 3A, 3B with a corresponding door controller. Besides the connecting doors between the cars 1, exterior doors for the passengers to embark and disembark are also provided, which likewise have corresponding door controllers. In addition, each car 1 of the rail vehicle can have a car controller 4 that is connected to a train controller or train control system via a bus, as shown in FIG. 2. A train bus 11 connects train controllers 11 to car controllers 4 of different cars 1, each of which has at least one base station 5 connected to it. In addition, a fixed terminal 13 may be connected to the train bus 11, said fixed terminal being located in a train conductor compartment, for example. As FIG. 1 shows, the car 1 in the exemplary embodiment shown additionally has two base stations 5A, 5B, which can be located at the two ends of the car. In the exemplary embodiment shown, the car 1 additionally contains, as functional units, passenger emergency brakes 6A, 6B that a passenger or a train conductor can use to prompt emergency braking of the rail vehicle. In addition, in the exemplary embodiment shown, the car 1 contains a loudspeaker 7 for announcements to the passengers. Furthermore, there may be fire alarms or fire alarm sensors 8 in the car 1 of the rail vehicle, for example. In the exemplary embodiment shown in FIG. 1, the car 1 additionally contains an air-conditioning system 9 with a corresponding controller.

A multiplicity of further functional units may be accommodated in the car 1 of the rail vehicle. The number of base stations 5A, 5B within the car 1 can vary, depending on the length of the car. In one preferred embodiment, the base stations 5A, 5B may be WLAN base stations. The WLAN base stations within the train car 1 use a radio interface or wireless interface to communicate with a mobile terminal 10 of a user. This user is an authenticated user, particularly an authenticated train conductor. The communication between the base stations 5A, 5B and the mobile terminal 10 is preferably effected in encrypted form, so that unauthenticated third users have no opportunity to perform operator control of functional units of the rail vehicle. Furthermore, to increase safety, the mobile terminal 10 is first of all registered on a fixed terminal within the rail vehicle and authenticated to the operator control system. To this end, the rail vehicle preferably contains at least one fixed terminal on which a train conductor or user can register his mobile terminal 10 for participation in the operator control system. During registration, the user can authenticate himself to the operator control system as authorized. Both the registration of the mobile terminal 10 and the authentication of the user to the operator control system are preferably effected on a fixed operator control terminal that is inaccessible to unauthorized users, particularly passengers or the like. By way of example, this fixed operator control terminal is located in a train conductor compartment that is additionally lockable with a security lock. The authentication process used therefore requires access to the fixed operator control terminal in the train conductor compartment, which is locked with a security lock. In one possible variant embodiment, the authentication to the operator control system is effected using a password or a PIN number. In addition, it is possible for the authentication to be performed using a certificate of the mobile terminal 10. In a further variant, the authentication can be performed using a bar code displayed on a display, which bar code can be photographed by a camera of the mobile terminal 10, for example.

In one possible variant embodiment of the operator control system according to the invention, registration of a mobile terminal 10 prompts selection, for the user thereof, of a predetermined role, each role providing the respective user with particular associated access rights for particular functional units of the rail vehicle. During registration of the mobile terminal 10, it is possible to stipulate which role is provided with which types of operator control options. By way of example, the different users may be a locomotive driver, a train manager, a train conductor or service personnel within the train. By way of example, faults that arise in the train are signaled only to the user taking on the role of a train manager of the train. In addition, it is possible for particular operator control options for functional units to be provided only for particular roles. By way of example, announcements or door blocks are permitted only for the train manager or his representative.

In one possible variant embodiment, the communication between the base stations 5A, 5B and the mobile terminal 10, which can be moved or worn by the user within the car 1, takes place in a particular channel or frequency band provided for this purpose. The frequency band or this channel is preferably separate from further channels for the use for ordinary data transmission, for example between terminals of passengers and the base stations. This further increases safety vis-à-vis faults and manipulations.

In one possible embodiment of the operator control system according to the invention, the current position of the mobile terminal 10 of the user within the rail vehicle is recorded using the base stations. This particularly involves recording the car that currently contains the train conductor or user. Furthermore, besides localization of the mobile terminal 10 within the whole rail vehicle, it is additionally possible for precise localization of the location of the mobile terminal 10 within a car 1 of the rail vehicle to be effected. By way of example, a layout plan or equipment plan of the car is used to establish the row of seats within the car 1 in which the mobile terminal 10 of the train conductor or user is currently located.

In one preferred embodiment of the operator control system according to the invention, the operator control of the functional units of the rail vehicle is effected on the basis of the current position of the mobile terminal 10 of the authenticated user. If a train conductor, for example, adjusts the air-conditioning unit as a functional unit, the air-conditioning system or the air-conditioning unit 9 within that car 1 of the rail vehicle that currently contains the mobile terminal 10 of the train conductor is automatically preselected for operator control and the remainder of the air-conditioning systems in the other cars remain unaltered.

Furthermore, in one possible embodiment, the operator control of functional units is additionally effected on the basis of the precise current position of the mobile terminal 10 within the car 1. If the train conductor, for example, picks up damage or a defect, for example damaged seats or the like, within a car 1, the precise location of the damage is concomitantly recorded, for example the row of the damaged seats, automatically without special input from the train conductor. In addition, the car 1 that contains the damage that has occurred is recorded. The defects picked up by the train conductor in the different cars at the different locations within the cars are preferably stored by the train control system in a database or a data memory of the rail vehicle and can be automatically read for later maintenance measures. The data can be used to direct maintenance personnel specifically to the precise locations at which defects have arisen. By way of example, maintenance personnel can likewise have an appropriate mobile terminal 10 and be directed to the location of the defect that has arisen. Localization of the position of the mobile terminal 10 therefore facilitates the operator control of functional units for the rail vehicle by the train conductor and additionally avoids misadjustments. Furthermore, localization of the mobile terminal 10 serves to increase efficiency, particularly for maintenance measures or the like.

In one possible variant embodiment of the operator control system according to the invention, the mobile terminal 10 is localized within a car 1 by evaluating a signal strength of a signal that is interchanged between the mobile terminal 10 and at least one of the base stations 5A, 5B. The closer the mobile terminal 10 is to the base station, the higher the received signal strength. In one possible variant embodiment, the mobile terminal 10 emits an appropriate measurement signal that is processed by a base station 5A, 5B in order to ascertain the position or the distance of the mobile terminal 10 from the base station. In a further variant embodiment, what is known as time-of-flight evaluation is effected, i.e. the signal propagation time between the mobile terminal 10 and the base station is ascertained and the position of the mobile terminal 10 within the car 1 is determined therefrom. The use of a plurality of base stations, for example two base stations, as in the exemplary embodiment shown in FIG. 1, allows the precision of the determination of the position of the mobile terminal 10 within the car 1 to be increased. In a further variant embodiment, the angle of incidence of the received signal is evaluated by the base station (angle of arrival). This allows an additional increase in the precision of the determination of the position of the mobile terminal 10 within the car 1. By way of example, three-dimensional position finding is performed and the coordinates x, y, z of the mobile terminal 10 within the car 1 are computed.

In one possible embodiment, functional units within the rail vehicle are controlled on the basis of the computed coordinates x, y, z of the mobile terminal 10 within the car and also the ascertained car number of the car 1. Using the mobile terminal 10, the authenticated user can operate a wide variety of functional units within the car 1 or the rail vehicle simply and efficiently.

FIGS. 3 to 14 show different exemplary applications for the adjustment of functional units using a mobile terminal 10 of an authenticated user, particularly an authenticated train conductor. In one preferred embodiment, the mobile terminal 10 has a graphical user interface that the user can use to control functional units of the rail vehicle or that the user can use to obtain information from function control units. The graphical user interface is preferably what is known as a touch screen, which allows the user to input control commands by touching sensitive areas.

Figure 3:
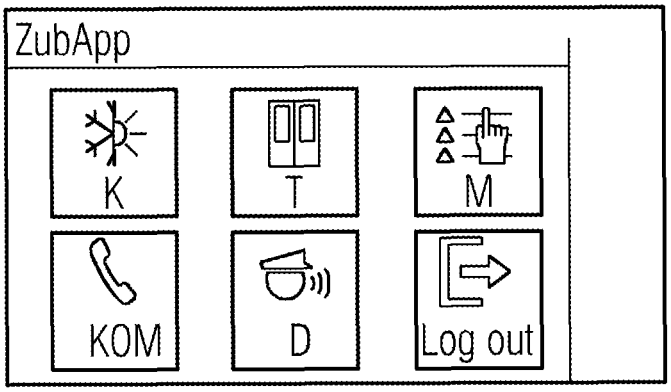
FIGS. 3 to 14 show display views on a graphical interface of a mobile terminal of the operator control system according to the invention to explain various exemplary applications for the operator control of functional units for a rail vehicle.

FIG. 3 shows a possible embodiment of a displayed main menu that can be displayed on a display of a graphical user interface of the mobile terminal 10. In the example shown, the user or train conductor can activate different functions, namely an air-conditioning unit or an air-conditioning system K within the car or doors T within the rail vehicle. Furthermore, the train conductor can pick up defects M or conduct communication KOM with further users within the rail vehicle. Furthermore, the user can activate announcements D and log out from the operator control system. Furthermore, additional useful information is displayed to the train conductor, particularly the time of day and the information concerning whether error messages are existent.

Figure 4:
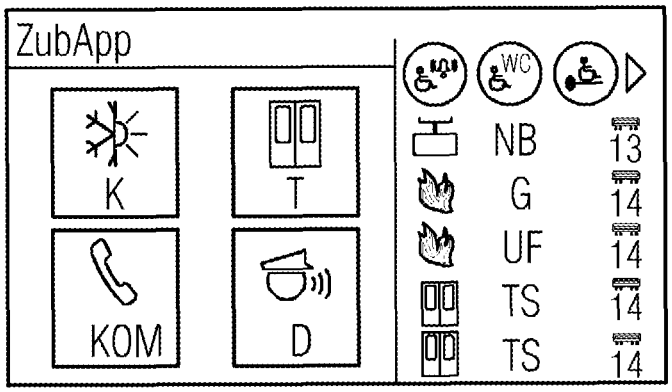

If error messages or fault reports are available, these can likewise be displayed on the display of the mobile terminal 10, as shown in FIG. 4. By way of example, it is possible to show that an emergency brake NB in car 13 has been operated or a galley G in car 14 is on fire. In addition, in the example shown, the train conductor is provided with an indication that the underfloor area UF in car 14 is on fire and this car additionally has two door faults TS on different doors. In addition, the train conductor is provided with a graphical indication that an emergency call has been generated in the disabled toilet.

Figure 5:
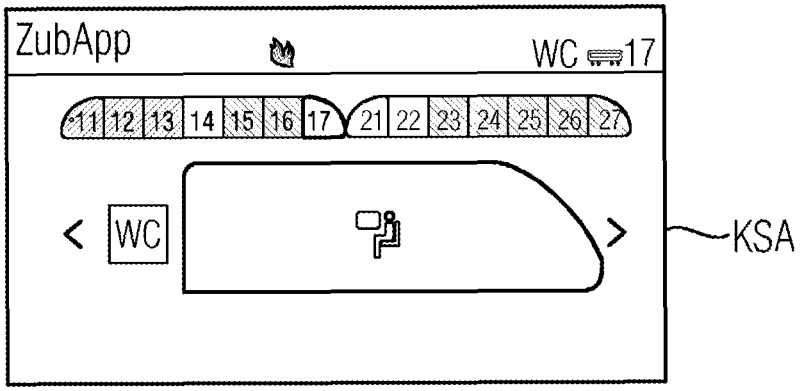

FIG. 5 shows a display for a fire alarm on a display of the mobile terminal 10. The user is provided with an indication of the car in which the fire has occurred. In the exemplary embodiment shown, the fire call has been generated in the car with the car number 17. As in the example shown, the operator control system provides the opportunity for the user to perform a central rapid shutdown for the air-conditioning systems for the whole train or the whole rail vehicle in the event of a fire in order to prevent the spread of smoke gases within the rail vehicle. By way of example, the train conductor can deactivate the air-conditioning system in the whole train by touching the sensitive areas "Air conditioning immediately off KSA".

Figure 6:
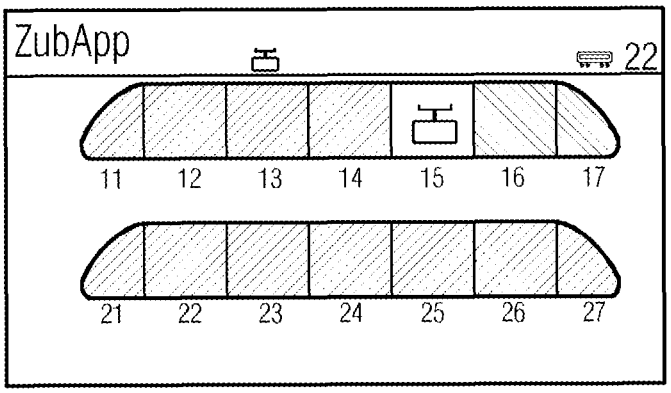

FIG. 6 shows an example of the display for a pulled passenger emergency brake in car 15 of the rail vehicle. The menu therefore allows the presentation of pending alarms and warnings and of indications in topic-specific graphical overviews.

Figure 7:
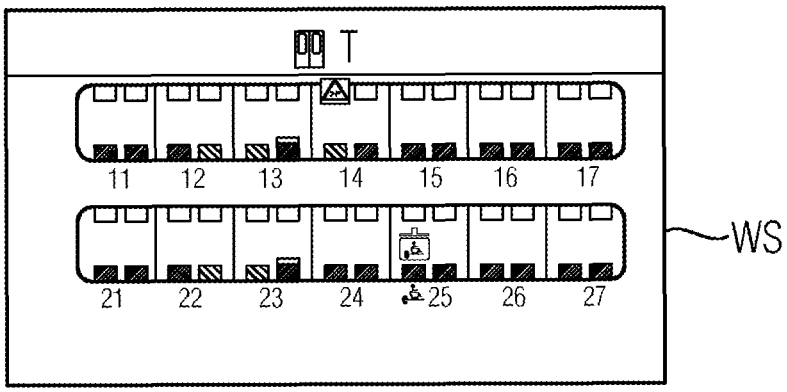
Figure 8:
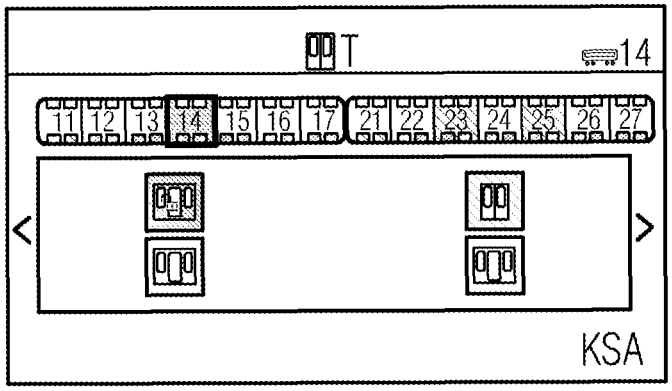
Figure 9:
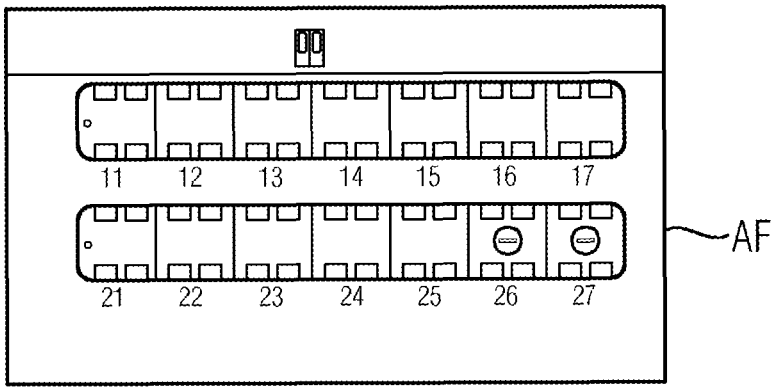

FIG. 7 shows an example of the display of door states for different cars 1 of the rail vehicle. Door states are presented for every single door of the train, for example whether the door T is closed and locked or released or open. In addition, a fault on the respective door T can be displayed or whether the door has been closed off using a square wrench or whether it has been unlocked in an emergency. By operating an appropriate sensitive area WS (block car), the train conductor has the option of blocking the doors T on a car-by-car basis. The blocked doors T are displayed to the train conductor. The train conductor can also be provided with an indication of door details, as shown by way of example in FIG. 8, for example. The train conductor is provided with a graphical indication of different door states. By way of example, in the example shown in FIG. 9, the doors T in car 26, 27 are blocked. By touching a button AF (release all), the train conductor has the option of releasing the doors T again.

Figure 10:
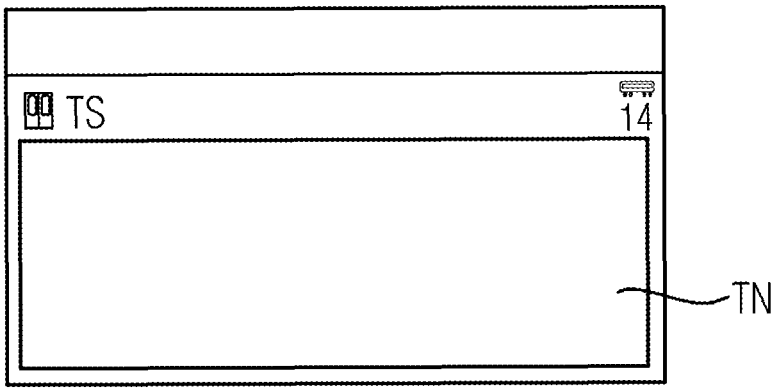
Figure 11:
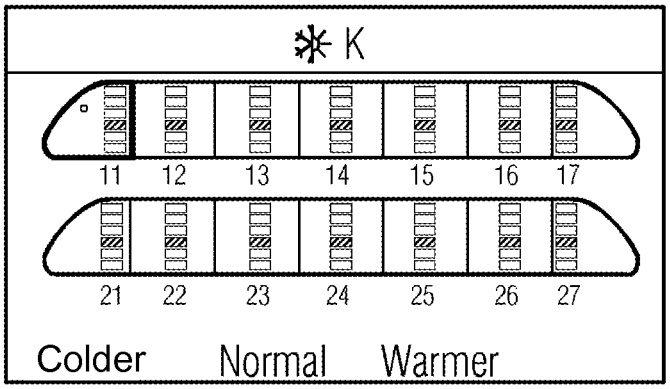

The train conductor also has the option of having a detailed piece of remedial information displayed for the respective fault, as shown by way of example in FIG. 10. In the example shown, a door fault has occurred in car 14. The train conductor is provided with assistance regarding how he can rectify the door fault. To this end, he is sent an appropriate text message TN, as shown in FIG. 10.

In a further possible embodiment, the train conductor has the option of adjusting air-conditioning systems 9 in different cars 1, for example by operating corresponding slide controls that are displayed graphically on his display. This is shown by way of example in FIG. 11. In one possible embodiment, an air-conditioning unit 9 is additionally adjusted on the basis of the position of the respective user or train conductor. In one possible variant embodiment, the train conductor only has the option of adjusting the air-conditioning unit 9 within that car 1 that the currently occupies. Furthermore, functional units within the rail vehicle can additionally be adjusted on the basis of the allocated role of the user. By way of example, a train conductor can thus only adjust the air-conditioning system within that car 1 that he currently occupies, whereas a train manager, for example, has the option of adjusting all air-conditioning systems in all cars of the rail vehicle centrally. Furthermore, further users, for example normal service personnel, usually have no rights to adjust any air-conditioning systems within the rail vehicle.

In one possible embodiment, the users with various roles are shown various menus for operator control of functional units.

Figure 12:
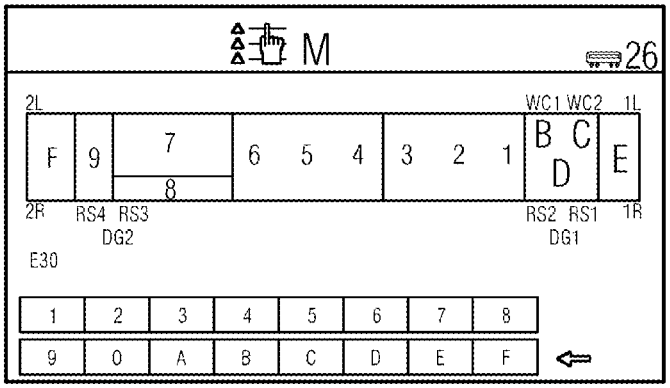
Figure 13:
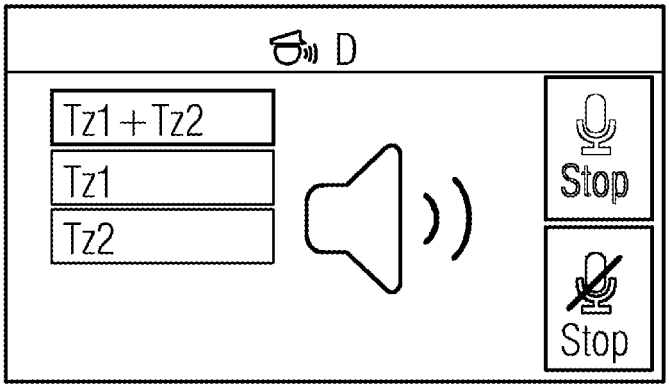

Using the operator control system according to the invention, a user or a train conductor has the option of making defect inputs directly in situ, as shown by way of example in FIG. 12. By way of example, defects can be input using a defined defect code or alternatively by means of menu-guided selection. The input defects M are preferably loaded in a central data memory of the rail vehicle. In this case, the information concerning the location within the rail vehicle at which the defect has been picked up by the user or train conductor is additionally transmitted. The corresponding data record therefore has the position coordinates x, y, z of the inputting train conductor within the car 1 and also the car numbers of that car 1 in which the defect input M is made. Furthermore, the user or train conductor can use a camera that is existent in the mobile terminal 10 to take a photograph containing the defect that has been found for the purposes of illustration and likewise to describe said photograph in more detail using free text in addition. In the example shown in FIG. 12, the user or the train conductor who is in car 26 can input that the carpet in this car is heavily soiled (TSV), for example, and can input a defect code 3 and the precise location of the defect.

In addition, the train conductor has the option of making announcements locally or in the whole rail vehicle. This is shown by way of example in FIG. 13. The announcements are output audibly via the loudspeakers 7 within the cars 1 of the rail vehicle. In one possible variant embodiment, particular audible announcements are stored in advance and then merely need to be activated by the train conductor by operating an appropriate sensitive area.

Figure 14:
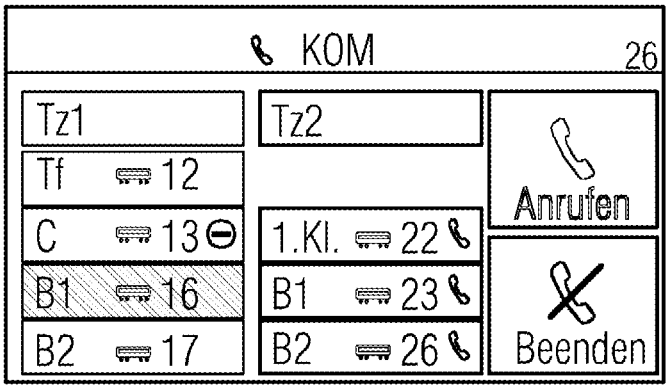

In addition, the operator control system according to the invention allows communication KOM between different train conductors within the rail vehicle, as shown in FIG. 14. The user recognizes further authenticated users with different roles in different cars of the rail vehicle and can activate direct communication with the respective user, for example for a telephone call between the users.

The operator control system according to the invention can therefore be used to perform operator control actions at precisely the location at which the reason for the operator control action exists or arises. By way of example, air-conditioning adjustments are usually made on the basis of passenger requirements that are expressed. The train conductor or user can therefore make the air-conditioning adjustment in situ immediately as a reaction to the passenger requirement and does not first need to go to a fixed terminal that may even be several cars further away within the rail vehicles. Furthermore, the train conductor does not need to remember the passenger requirement and cannot forget it. In addition, the passenger can immediately gather that his concern is immediately implemented.

In addition, the operator control system according to the invention allows defects within the rail vehicle to be input directly where the defect is located. The train conductor does not need to remember or write down the defect until he has arrived at the next fixed operator control station. This likewise prevents the train conductor or user from forgetting the defect he has noticed before input or from forgetting the precise place at which the defect has arisen. Furthermore, the defect that has arisen can be input by the train conductor more quickly, since the current position of the train conductor is recognized by the operator control system and hence input of his own position, for example the car number, becomes superfluous. This results in a higher level of operator control efficiency. In addition, the train conductor has the option of also directly inputting additional information, for example photographs or free text, that describes the respective defect more precisely. This is extremely useful, particularly for the preparation and performance of maintenance measures within the rail vehicle.

As a result of the presentation of a door release status, it is additionally possible to avoid undesirable delays during a disembarkation process. The operator control system according to the invention provides the train conductor with the option of immediately recognizing whether the traction unit driver of the rail vehicle has possibly not yet released the doors, and can likewise notify the traction unit driver accordingly.

The operator control system according to the invention also allows doors to be excepted from release at short notice and taking account of local circumstances. Such local circumstances are a short platform, the train braking off-platform or unusable platform sections within a station, for example.

Furthermore, the operator control system according to the invention integrates the communication among the train personnel. The operator control system according to the invention allows the mobile terminal 10 to be used to make announcements D. In this way, it is possible to dispense with the conventional cordless telephones. In the case of the operator control system according to the invention, alarms, warnings and indicators are transmitted to the train conductor in real time and in detail. In addition, visual conditioning using colors and graphical symbols allows the transmitted information or warnings to be comprehended more quickly by the train conductor.

Displayed faults, particularly in graphical form, allow the train conductor to obtain an overview of the whole situation more quickly and to react accordingly. This allows a reaction to particular alarm signals in real time and in an appropriate manner directly in situ, for example by quickly shutting down the air-conditioning system in the event of a fire.

In addition, the operator control system according to the invention allows extensive remedial measures in the event of a fault to be displayed at the location at which they are needed, i.e. usually directly at the location of the fault that has occurred. This facilitates handling or rectification of the fault that has occurred. The displayed remedial measures facilitate rectification of the fault and prevent erroneous measures by the train conductor. This speeds up the remedial measure and significantly increases the quality of performance of the remedial measure.

The operator control system according to the invention can be coupled to further systems, particularly to an order system for train tickets, to a timetable information system for a rail network, to a passenger information system and to a navigation system. By way of example, if a passenger wishes to know the current location of the train or when the next station will be reached, the coupling to a navigation system allows this to be graphically displayed to the passenger on a display of the mobile terminal immediately. In addition, the passenger can have a ticket issued directly to him by the train conductor when the operator control system is coupled to an order system.

The invention claimed is:

1. An operator control system for operator control of functional units for a rail vehicle having a plurality of cars, the operator control system comprising:

a plurality of base stations, each car of the rail vehicle containing at least one of said base stations; and a mobile terminal of an authenticated user, said mobile terminal being configured with a wireless interface and a graphical user interface of the mobile terminal to enable operator control of functional units of the rail vehicle;

said mobile terminal communicating with said base stations via a wireless interface; and wherein, upon a registration of said mobile terminal, a predetermined role is selected for the user of the mobile terminal with associated access rights for particular functional units of the rail vehicle.

2. The operator control system according to claim 1, wherein the authenticated user is an authenticated train conductor.

3. The operator control system according to claim 1, wherein the rail vehicle contains at least one fixed terminal on which said mobile terminal of the user is registered for participation in the operator control system.

4. The operator control system according to claim 1, wherein a current position of the mobile terminal of the user within the rail vehicle is recorded.

5. The operator control system according to claim 4, wherein the current position of the mobile terminal includes information concerning the car of the rail vehicle that contains the user.

6. The operator control system according to claim 4, wherein the operator control of a functional unit of the rail vehicle is effected in dependence on the recorded current position of the mobile terminal of the user and/or on the role of the user.

7. The operator control system according to claim 4, wherein the current position of the mobile terminal of a user within the rail vehicle is recorded by way of said base stations provided in the different cars of the rail vehicle.

8. The operator control system according to claim 4, wherein a display of the user interface of the mobile terminal of the authenticated user is configured to display respective current positions and allocated roles of further authenticated users of the operator control system within the rail vehicle.

9. The operator control system according to claim 1, wherein said base stations are connected to a control bus of a train control system of the rail vehicle that controls the functional units of the rail vehicle.

10. The operator control system according to claim 1, wherein said base stations are WLAN base stations configured to communicate with said mobile terminal of the authenticated user bidirectionally via a wireless interface.

11. The operator control system according to claim 10, wherein the bidirectional communication between a respective said base station and said mobile terminal of the user is effected in encrypted form.

12. The operator control system according to claim 10, wherein the bidirectional communication between the authenticated user of the mobile terminal and further mobile terminals of users of the operator control system within the rail vehicle is effected via a closest base station to the mobile terminal of the authenticated user and via a bus of the train control system of the rail vehicle.

13. The operator control system according to claim 1, wherein the authentication of the user to the operator control system is effected on a fixed operator control terminal that is not accessible to unauthorized users.

14. The operator control system according to claim 1, wherein the functional units of the rail vehicle are selected from the group consisting of a lighting system, loudspeakers, an air-conditioning system, door blocks, a fire alarm system and emergency brakes of the rail vehicle.

15. A method for operator control of functional units for a rail vehicle, the functional units being selected from the group consisting of a lighting system, loudspeakers, an air-conditioning system, door blocks, a fire alarm system and emergency brakes of the rail vehicle, the method comprising:

providing each car of the rail vehicle with at least one base station and selectively establishing a communication between a base station and a mobile terminal of an authenticated user via a wireless interface;

the authenticated user using a graphical user interface of the mobile terminal for operator control of functional units of the rail vehicle; and upon registration of the mobile terminal selecting a predetermined role for the user, the predetermined role having associated access rights for particular functional units of the rail vehicle.

16. The method according to claim 15, wherein the authenticated user is an authenticated train conductor.

17. A rail vehicle, comprising an operator control system according to claim 1.

18. The rail vehicle according to claim 17, wherein the operator control system of the rail vehicle is coupled to one or more systems selected from the group consisting of an order system, a timetable information system, a passenger information system, and a navigation system of the rail vehicle.

* * * * *